US006877883B2

(12) United States Patent
Lau Ting Yup et al.

(10) Patent No.: US 6,877,883 B2
(45) Date of Patent: Apr. 12, 2005

(54) ORNAMENTAL SPHERE

(76) Inventors: Patrick Lau Ting Yup, 14 Westlands Road, Third Floor, Flat C, Aik San Factory Building, Quarry Bay (HK); Jeff Wilkie, 11288 Ventura Blvd., Suite 124A, Studio City, CA (US) 91604

( * ) Notice: Subject to any disclaimer, the term of this patent is extended or adjusted under 35 U.S.C. 154(b) by 0 days.

(21) Appl. No.: 10/208,284

(22) Filed: Jul. 30, 2002

(65) Prior Publication Data

US 2003/0067764 A1 Apr. 10, 2003

(30) Foreign Application Priority Data

Aug. 21, 2001 (GB) ..... 0120306

(51) Int. Cl.[7] ..... F21V 33/00

(52) U.S. Cl. ..... 362/363; 362/96; 362/101; 362/806; 362/318

(58) Field of Search ..... 40/406, 409; 362/96, 362/101, 318, 806

(56) References Cited

U.S. PATENT DOCUMENTS 4,961,276 A 10/1990 Lin
6,241,359 B1 * 6/2001 Lin ..... 362/96
6,681,508 B1 * 1/2004 Unger et al. ..... 40/406
2002/0174578 A1 * 11/2002 Ross ..... 40/409

OTHER PUBLICATIONS

"Rheoscopic Fluid," Novostar, www.novostar.com/Rheoscopic.htm.

* cited by examiner

*Primary Examiner*—Stephen Husar
*Assistant Examiner*—Anabel Ton
(74) *Attorney, Agent, or Firm*—Chapman and Cutler LLP

(57) ABSTRACT

An ornamental sphere includes a base and a transparent or translucent sphere mounted on the base. The sphere is completely filled with rheoscopic fluid. A driving apparatus within the sphere is energized to agitate the rheoscopic fluid to thereby create currents or movements that are visible to an observer through the sphere. In addition, a light source is mounted within the sphere to illuminate the rheoscopic fluid and enhance the appearance and visibility of the current movement. The light and/or the driving apparatus can be activated by a plurality of systems. Alternatively, the sphere can be filled with two immiscible fluids having different refractive indexes.

33 Claims, 4 Drawing Sheets

ORNAMENTAL SPHERE

BACKGROUND OF THE INVENTION

The novelty sphere of the present invention is an improvement on conventional "crystal balls" by providing additional features and advantages. Crystal balls or light globes as they are also known, typically are designed for standing on a work top or casual table. These novelty globes generally have a transparent or translucent spherical exterior and may incorporate a light source that illuminates the globe from the inside so that a stationary pattern or colored lamp is provided for general illumination or novelty situation, such as their use in magic shows. While many such globes may have utilitarian functions and the illumination may be aesthetically patterned or colored, the illumination or effect in the past has been "static."

SUMMARY OF THE INVENTION

According to the present invention there is provided an illuminated spherical "globe" having an outer transparent or translucent shell forming a watertight enclosure. A driving apparatus and a light source are mounted within the sphere for selective actuation. The sphere is filled with a rheoscopic fluid or with at least two different immiscible liquids having different refractive indexes, such that randomly moving currents or patterns are visible externally of the globe when in use. Alternatively, the sphere can be filled with a substantially clear fluid, such as water, and a plurality of relatively larger particles to provide a vortex-type pattern generally about the axis of the driving apparatus.

The rheoscopic fluid is a low viscosity fluid, such as water, in which are suspended microscopic crystals that can show current movement continually without dispersing over time while also permitting the fluid to be dyed or colored to create many colorful appearances. The microscopic crystals will, over a long period of non-use, settle to the bottom of the sphere.

The spherical portion of the present invention is sealed so as to be "watertight" to prevent leakage of any of the fluid and, therefore, the driving apparatus preferably includes an impeller on the inside of the sphere connected to a permanent magnet and a cooperating magnet on the outside of the sphere connected to the shaft of a motor which is selectively actuable. The "magnetic connection" between the elements agitates the fluid within the sphere to create the new and unusual effects.

DETAILED DESCRIPTION OF THE PREFERRED EMBODIMENT

Figure 1:
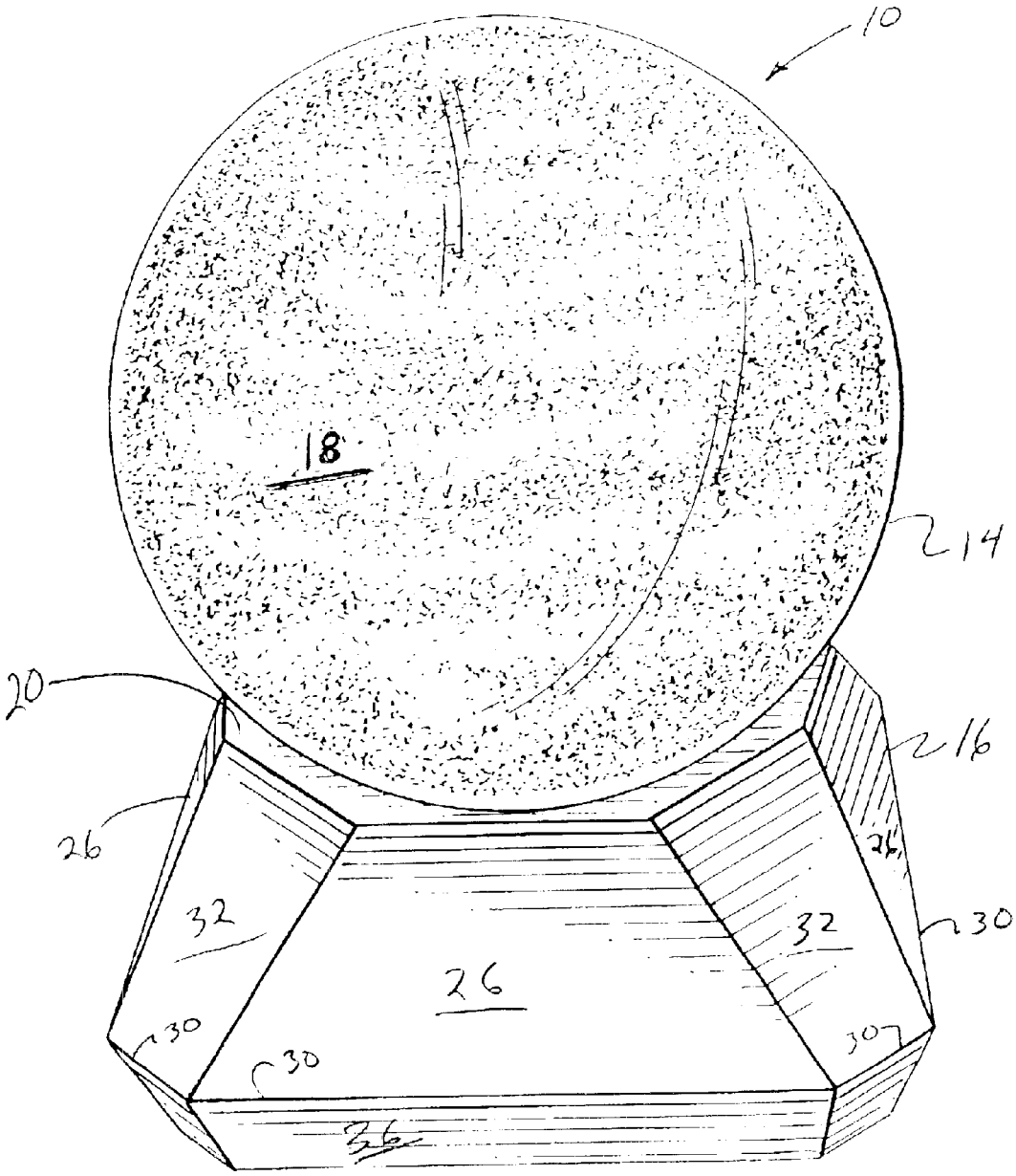
FIG. 1 is a perspective view of the ornamental sphere of the present invention.

The ornamental sphere, generally designated 10 is shown in a perspective view in FIG. 1. The ornamental sphere includes a top spherical portion 14 and a lower support base portion 16. The sphere 10 is made of transparent or translucent glass or plastic so that the interior volume within the sphere is visible from the outside. The sphere 10 is filled with a fluid generally designated 18 to create the new and unusual entertaining currents or visibly moving wavy patterns as will be described in detail hereinafter. The currents or wavy patterns to some look similar to clouds being blown across the sky or visible water currents. The fluid 18 can be of several forms, but in the preferred embodiment, is a rheoscopic fluid. A rheoscopic fluid is a fluid of relatively low viscosity, in which are suspended or mixed microscopic crystals that show the current movement continually over time. Typically, the microscopic crystals in a rheoscopic fluid are slightly denser than the carrier fluid and will settle out over a long period of time. When the liquid 18 is agitated, as described in greater detail below, the rheoscopic fluid mixes within the sphere 14 creating the unusual and entertaining wavy patterns and currents that are visible to the observer.

Alternatively, the sphere 14 could be filled with a mixture of two immiscible liquids, each of which has a different refractive index, so that a similar effect of wavy patterns and currents would be visible to the observer. Likewise, a relatively clear fluid could be used and a plurality of relatively larger particles could be introduced to provide a vortex-type pattern generally about the axis of the driving apparatus described in detail hereinafter.

Figure 3:
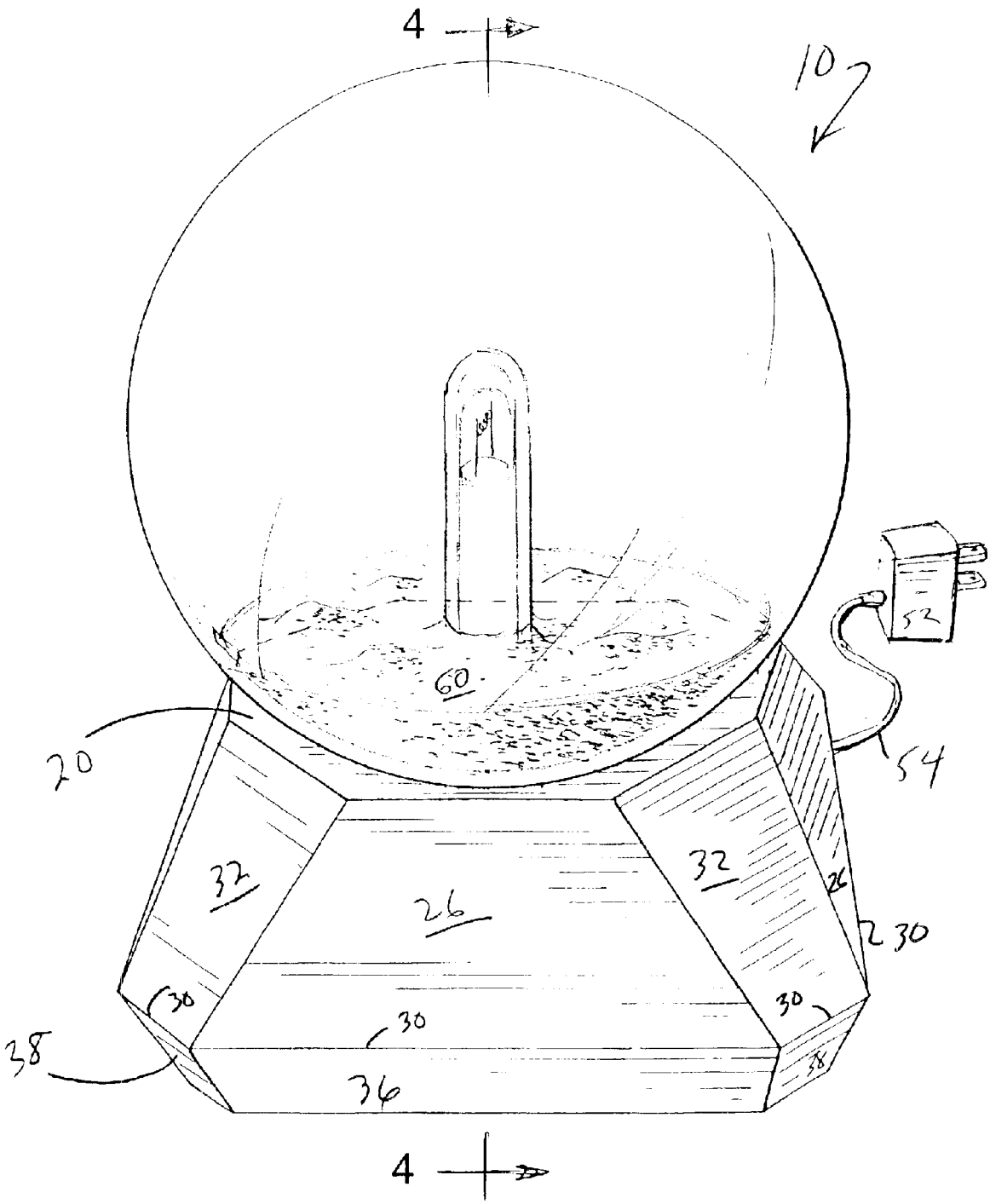
FIG. 3 is a perspective view of the present invention in which the microscopic crystals within the rheoscopic fluid have settled to the bottom portion of the sphere.
Figure 4:
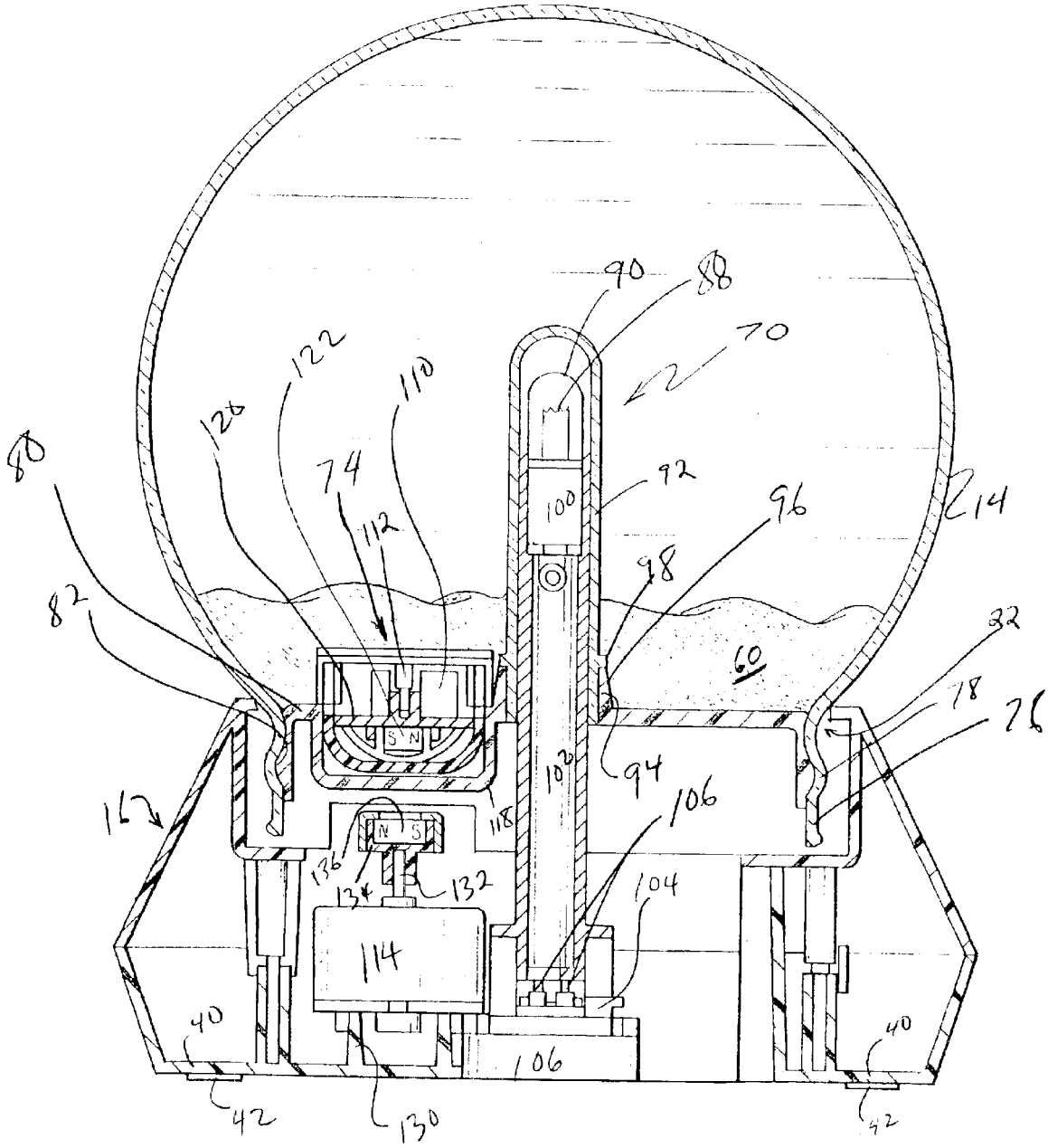
FIG. 4 is a vertical section taken generally along the line 4—4 of FIG. 3.

The base 16 includes a top or upper surface 20 which has an annular opening 22 for receiving and contacting the lower portion of the sphere 14 as shown in FIGS. 3 and 4. The base 16 has four relatively large outwardly depending panels or walls 26 which depend from an edge of the top wall 20 to a line or hip 30 which defines a transition point. Each edge or corner where the adjacent walls 26 would normally meet at the upper surface are chamfered or flattened to provide for four additional wall portions 32. Each of the sidewall portions 32 depends downwardly and outwardly from an edge on the top surface 20 and, if the chamfer is large, terminate at the line or hip 30.

Figure 2:
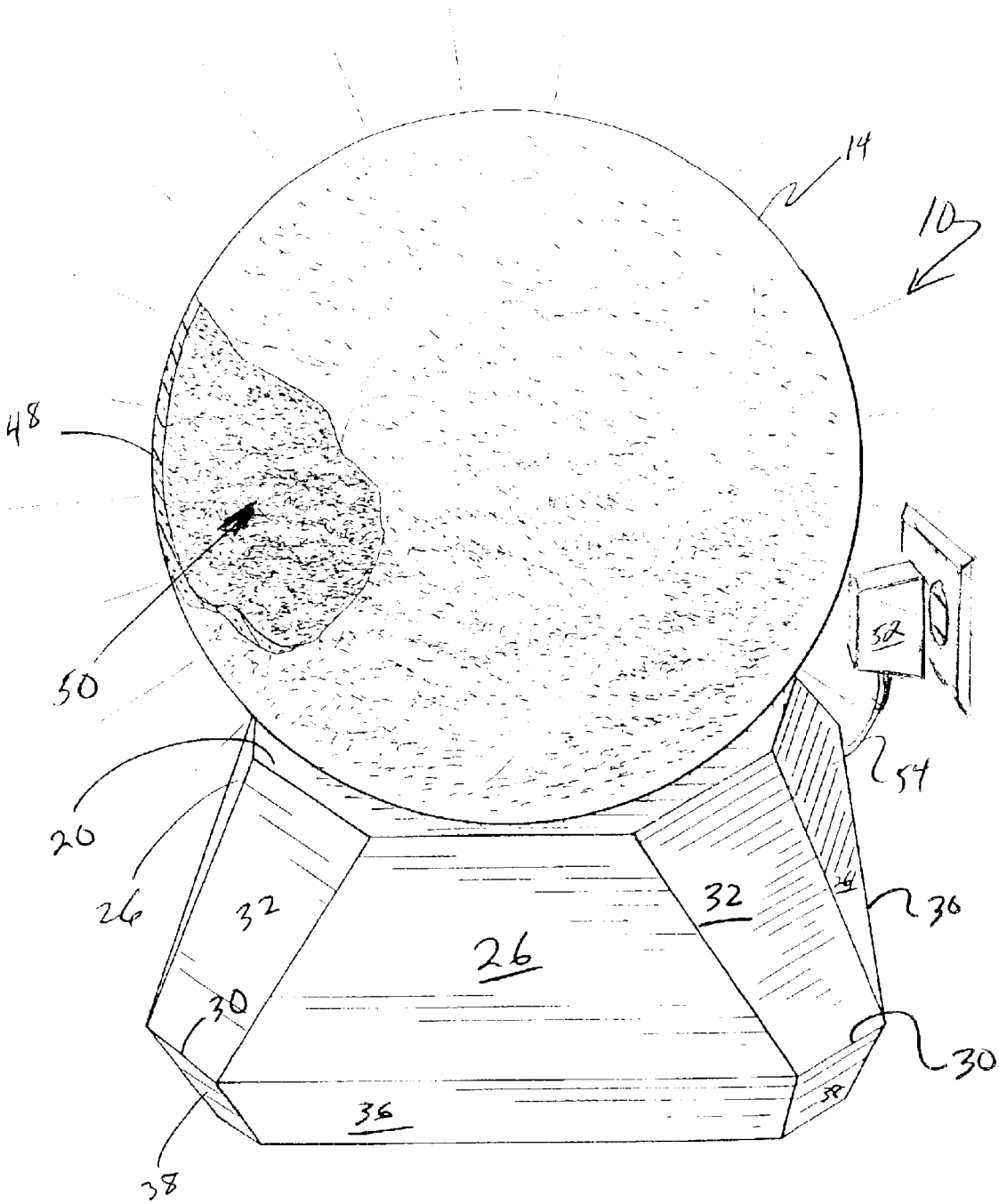
FIG. 2 is another perspective view of the present invention showing a cut away section of the sphere.

Another set of smaller wall portions extend downwardly from the hip 30 as follows. Four generally large sidewall portions 36 extend downwardly from the hip 30 as shown in FIGS. 1 and 2, and a similar number of smaller sidewall portions 38 (if the chamfer is large) depend from the hip line 30 adjacent each of the sidewall portions 32. In the embodiment as shown in the figures, the lower depending walls 36 and 38 depend at a different angle and are shown to depend inwardly and meet with a base plate or bottom wall portion 40. A plurality of feet 42 are mounted adjacent each corner on the base plate 40 to support the base 16. The base 16 including sidewalls 26, 32, 36 and 38 and the base plate 40 and the top wall 20 can be molded as a single unitary piece as shown by the cross-hatching in FIG. 3 with a plurality of internal structural supports as will be described in greater detail with respect to FIG. 4 hereinafter. The particular shape and configuration of the base as shown in FIG. 1 is designed to support the sphere 14 and contain within itself the operative elements. For example, if desired, the base could be substantially taller or larger than the sphere 14 and the depending wall portions 32 could be different in shape, particularly if the chamfer is smaller. Similarly, the lower wall portions 36 could, by design choice, extend at another angle. All of these variations are a matter of design choice.

Referring to FIG. 2, a cut away section 48 in the sphere 14 is shown, in which the currents or a moving, wavy pattern 50 is illustrated. Also, FIG. 2 shows an electrical connector 52 and connecting wire 54 which are used to provide electrical power to the ornamental sphere 10. As described heretofore, in the preferred embodiment, the sphere 14 is filled with a rheoscopic fluid that includes a fluid portion with low viscosity, such as water or the like, and microscopic crystals which flow within the water to create the moving current or wavy pattern appearance. The microscopic particles 60 will, over a long period of inactivity, fall by gravity to the bottom portion of the sphere 14 adjacent the base 16 and collect at the bottom thereof as shown in FIGS. 3 and 4.

Referring in particular to FIG. 4, a vertical section is shown of the interior elements of the ornamental sphere. The internal elements include a light source generally designated 70 and a drive means generally designated 74. The sectional view of FIG. 4 also shows that the spherical portion 14 is open at the bottom end as oriented in FIG. 4, and terminates in a circular throat or neck portion 76. The neck portion 76 includes an outwardly directed radius 78 for sealing the cavity within the sphere. In particular, a disk-like plug 80 is inserted within the neck 76 and includes a complementary, outwardly extending radius 82 which engages the radius 78 in the neck 76 in a complementary manner to seal the opening in the spherical portion 14. If desired, an adhesive material can be applied between the neck 76 of the sphere 14 and the plug 80 to ensure that a watertight seal is achieved.

A selectively actuable light source 70 is provided so that the actual "lighting element," such as the filament 88 in the light bulb 90, is located at approximately the center of the sphere 14 for optimal effect, although the light source could be located elsewhere. In order to permit replacement of the light source when necessary without destroying the integrity of the "sealed" sphere, an upwardly extending, generally transparent closed end tube 92 is mounted on the plug 80 through an aperture 94 created by an upstanding circular rib 96 preferably formed integrally with the plug 80. Again, the upstanding tube 92 includes a radial rib 98 which engages the top of the rib 96 and aligns the tube 92 in a direction perpendicular to the plug 80. Again, an adhesive may be used between the tube 92 and the rib 94 to ensure a watertight seal.

The light source 70 includes the filament 88 and housing 100 which is mounted on a vertically extending tube 102 which extends downwardly toward the bottom of the base 16. The tube 102 is connected at the bottom by a releasable connection such as a manually rotatable bayonet coupling 104 having a horizontal flange 106 which acts as a gripping portion for inserting and removing the light source. In use, the gripping portion is rotated approximately 90 degrees, thereby releasing the bayonet connection 104 and at the same time disconnecting the electrical contacts which energize the light source permitting removal of the tube 104, housing 100 and light source 88 for replacement of the light source or bulb when it is burned out. The bayonet connection 104 or any other removable connecting device, can be integrally molded within the base portion 16 so that the light source can be replaced if needed. Since the light source element 88 is located generally within the center of the sphere, the removable bayonet coupling and upstanding post 102 permits the light source to be easily removed and replaced from the bottom of the housing. An advantage of having the light source is that it provides additional visibility to the currents created within the rheoscopic fluid to the observer when looking at the exterior of the sphere 14 to enhance the appearance. However, the usefulness of the ornamental sphere and the visibility of the currents and patterns within the rheoscopic fluid are not dependent upon the light source which can be switched off by a conventional electric switch, and, in fact, are clearly and easily visible without a light source. Therefore, in the preferred embodiment, the light source is electrically actuated through the switch, so that, when desired, the light source can be turned off. Of course, the present invention also contemplates that the ornamental sphere can be made without any light source to save on the expense of the previously described construction and the power supply to support the light source within the sphere.

Finally, a driving apparatus 74 is provided to agitate the rheoscopic fluid and thereby stir the microscopic crystals 60 within the fluid to create the currents or movement effect visible through the exterior of the sphere. The driving apparatus includes an impeller body 110 that is rotatably mounted on a vertical axis 112 and magnetically coupled to a motor 114 as described below. In particular, the rotatably mounted impeller 110 is mounted within the sphere 114 on the "inside" of the plug 80 (within the fluid in the sphere) within a depression 118 formed in the plug to mount the impeller so that it is within the watertight spherical enclosure. The impeller 110 on the axis 112 is connected to a rotary housing 120 which carries a magnet 122 as best seen in FIG. 4. The magnet is marked with its South and North poles indicated by the letters "S" and "N" and the assembly is mounted so that the impeller 110 extends upwardly from the rotary housing 120 into the fluid in the sphere. The magnet 122 and the impeller 110 are freely rotatable on the vertical axis 112 and are fully contained with the rheoscopic fluid in the sphere 14.

A motor 114 is mounted on an upstanding circular flange 130 integrally molded with the base 16 with its rotating shaft 132 extending upwardly. A non-metallic connector 134 is mounted on the end of the shaft 32 and carries a complementary magnet 136 in a position so that it is axially aligned with the previously described magnet 122. The alignment of the magnets, with opposite poles attracting, magnetically couple the impeller 110 and the motor 114 such that when the motor is energized, the impeller 110 will be rotated essentially synchronously with the motor shaft 132 by virtue of the magnet coupling provided by the magnets 122 and 136 so that the impeller will rotate at the same revolutions per minute as the motor shaft 132. When actuated, the impeller 110 will agitate or circulate the rheoscopic fluid within the sphere to create the desired effect of variable moving wavy patterns or visible currents. The motor 114 may be provided with a manually adjustable speed controller that can be used to alter the pattern effect, typically to "speed up" or "slow down" the current movements. At higher motor speeds, the currents can be considered to be less prominent and apply described as a shimmering effect. In any event, the appearance of the ornamental sphere is never "static" as in the prior art, and adds novelty, and utility to a generally relaxing, decorative light source.

The chosen rheoscopic liquids or combinations of immiscible fluids may be clear or naturally colored or dyed according to design choices. By choosing different colors, different appearances can be created. Also, the viscosity of the fluid can be changed as desired. However, the desire is to provide consistent color of fluids using the proper levels of rheoscopic mixed with distilled water. It is also preferable to use an anti-fungal agent with the distilled water to prevent the growth of any bacteria. Of course, many variations of the previously described ornamental sphere can be made without departing from the scope of this invention. For example, as described above, it would be possible to make the ornamental sphere without the light source and or even without the driving apparatus. However, in the latter case, the user would have to manually agitate the fluid in order to create the desired effects. Similarly, the ornamental sphere as shown and described is disclosed with a power supply that plugs into a normal wall socket. Such a power supply and/or transformer is only one method of energizing the motor 114 and/or light source 88. For example, battery power could supply the source of power because batteries could last for a substantial period of time and there would be no need for a power supply cord or wire. Similarly, the adjustable speed motor and light source 88 as described above are switched to enable them to be selectively actuated, individually or together. However, other forms of activation devices could be used, such as sound activation, light activation, so that the ornamental sphere would automatically "turn on" at night, vibration activation so that it would automatically turn on if a vibration is felt, or any other type of automatic switching means such as a remote control, etc. Obviously, other variations are possible.

We claim:

1. A novelty device, comprising:

an upper, transparent generally spherical portion which is substantially filled with a rheoscopic fluid including a plurality of microscopic particles;

means for agitating the rheoscopic fluid to create currents that are visible through the sphere, said means including a selectively actuable drive means coupled to an impeller mounted within the sphere; and a lower base portion, said base including an upper surface for engaging the spherical portion, a first plurality of walls depending generally downwardly and outwardly from the upper surface and a second plurality of walls depending downwardly from said first plurality of walls.

2. A novelty device, comprising:

an upper, transparent generally spherical portion which is substantially filled with a rheoscopic fluid including a plurality of microscopic particles;

means for agitating the rheoscopic fluid to create currents that are visible through the sphere, said means including a selectively actuable drive means coupled to an impeller mounted within the sphere;

a lower base portion, said base including an upper surface engaging the spherical portion, a first set of four wall portions depending generally downwardly and outwardly from the upper surface and another set of four wall portions, each of which depends downwardly from one of the wall portions of said first set of walls; and a chamfered surface formed at the junction of the upper surface with each two adjacent side walls.

3. The novelty device of claim 2, wherein the transparent spherical portion is made of glass.

4. The novelty device of claim 2, wherein the selectively actuable drive means is magnetically coupled to the impeller in the sphere.

5. A novelty device, comprising:

an upper, generally translucent spherical portion which is substantially filled with a rheoscopic fluid including a plurality of microscopic particles;

means for agitating the rheoscopic fluid to create currents that are visible through the sphere, said means including a selectively actuable drive means coupled to an impeller mounted within the sphere; and a lower base portion, said base including an upper surface for engaging the spherical portion and a plurality of walls depending generally downwardly therefrom.

6. The novelty device of claim 5, wherein the drive means is magnetically coupled to the impeller mounted within the sphere.

7. The novelty device of claim 5, including a light source within the sphere to illuminate the rheoscopic fluid and enhance the appearance and visibility of the current movement.

8. A novelty device, comprising:

an upper, generally translucent spherical portion which is substantially filled with a rheoscopic fluid including a plurality of microscopic particles;

means for agitating the rheoscopic fluid to create currents that are visible through the sphere, said means including a selectively actuable drive means coupled to an impeller mounted within the sphere; and a lower base portion, said base including an upper surface for engaging the spherical portion and a plurality of walls depending generally downwardly therefrom including a removable light source within the sphere to illuminate the rheoscopic fluid and enhance the appearance and visibility of the current movement, wherein the base supports an upstanding closed end tube generally along the vertical central axis of the spherical portion for receiving the removable light source.

9. The novelty device of claim 8, wherein the light source is removably mounted for insertion into the closed end tube by a releasable coupling in the base.

10. The novelty device of claim 9, wherein the releasable coupling is a bayonet type mount.

11. A novelty device, comprising:

an upper, transparent spherical portion which is substantially filled with a rheoscopic fluid;

means for agitating the rheoscopic fluid to create current movement;

a generally rectangular lower base portion, said base including an upper surface for mounting the spherical top and a plurality of flat walls depending downwardly and outwardly from the top wall; and a light source is mounted within the sphere to illuminate the rheoscopic fluid and enhance the appearance and visibility of the current movement.

12. The novelty device of claim 11, wherein the agitation means is magnetically coupled to an impeller mounted within the sphere.

13. The novelty device of claim 12, including a light source within the sphere to illuminate the rheoscopic fluid and enhance the appearance and visibility of the current movement.

14. The novelty device of claim 13, wherein the base supports an upstanding closed end tube generally along the vertical central axis of the spherical portion for receiving a removable light source.

15. The novelty device of claim 14, wherein the light source is removably mounted for insertion into the closed end tube by a releasable coupling in the base.

16. The novelty device of claim 15, wherein the releasable coupling is a bayonet type mount.

17. An ornamental sphere comprising:

a base;

a sphere filled with a rheoscopic fluid mounted on the base; and a driving means for agitating the rheoscopic fluid to create visible currents through the sphere, including a selectively actuable, variable speed drive means in the base which is coupled to an impeller mounted within the sphere.

18. An ornamental sphere comprising:

a base portion;

a sealed, transparent sphere filled with a rheoscopic fluid mounted on the base;

a driving apparatus for agitating the rheoscopic fluid to create currents that are visible through the sphere, including a selectively actuable drive means in the base which is magnetically coupled to an impeller mounted within the sphere; and a light source is mounted within the sphere to illuminate the rheoscopic fluid and enhance the appearance and visibility of the current movement.

19. The novelty device of claim 18, wherein the drive means is magnetically coupled to the impeller mounted within the sphere.

20. The novelty device of claim 19, including a light source within the sphere to illuminate the rheoscopic fluid and enhance the appearance and visibility of the current movement.

21. The novelty device of claim 20, wherein the base supports an upstanding closed end tube generally along the vertical central axis of the spherical portion for receiving a removable light source.

22. The novelty device of claim 21, wherein the light source is removably mounted for insertion into the closed end tube by a releasable coupling in the base.

23. The novelty device of claim 22, wherein the releasable coupling is a bayonet type mount.

24. A novelty device, comprising:

an upper, generally translucent spherical portion which is substantially filled with a rheoscopic fluid;

means for agitating the rheoscopic fluid; and a lower base portion, said base including an upper surface for mounting the spherical top and a plurality of flat walls depending downwardly and outwardly from the top wall, said base also supporting a light source in the sphere.

25. An ornamental sphere comprising:

a base;

a sealed sphere filled with fluid mounted on the base;

a plurality of suspensible objects disposed within the fluid; and a drive means for agitating the fluid and the suspensible objects and create movement thereof which is visible through the sphere, said drive means including a selectively actuable drive motor mounted in the base which is magnetically coupled to an impeller mounted within the sealed sphere; and a light source is mounted within the sphere to illuminate the rheoscopic fluid and enhance the appearance and visibility of the current movement.

26. An ornamental sphere comprising a base;

a sphere filled with a rheoscopic fluid mounted on the base;

a plurality of suspensible objects disposed within the fluid; and a driving means for agitating the fluid and move the suspensible objects which is visible through the sphere, including a selectively actuable drive motor mounted magnetically coupled to an impeller mounted within the sphere.

27. The novelty device of claim 22, wherein the agitation means is magnetically coupled to the impeller mounted within the sphere.

28. The novelty device of claim 27, including a light source within the sphere to illuminate the rheoscopic fluid and enhance the appearance and visibility of the immiscible fluid.

29. The novelty device of claim 28, wherein the base supports an upstanding closed end tube generally along the vertical central axis of the spherical portion for receiving a removable light source.

30. The novelty device of claim 29, wherein the light source is removably mounted for insertion into the closed end tube by a releasable coupling in the base.

31. The novelty device of claim 30, wherein the releasable coupling is a bayonet mount.

32. A novelty device, comprising:

an upper, transparent generally spherical portion which is substantially filled with a rheoscopic fluid including a plurality of microscopic particles;

means for agitating the rheoscopic fluid to create currents that are visible through the sphere, said means including a selectively actuable drive means coupled to an impeller mounted within the sphere;

a lower base portion, said base including an upper surface, a first set of four wall portions depending generally downwardly and outwardly from the upper surface and another set of four wall portions, each of which depends downwardly from one of the wall portions of said first set of walls; and a flat, chamfered surface formed at each corner junction of the upper surface with each two adjacent side walls.

33. An ornamental sphere comprising:

a lower base portion formed in cylindrical shape;

an upper, transparent generally spherical portion mounted on the base portion, substantially filled with a rheoscopic fluid, wherein the spherical portion is mounted so as to be partially submerged within the base; and means for agitating the rheoscopic fluid to create visible currents through the spherical portion.

* * * * *